US007194773B2

(12) United States Patent
Bixby

(10) Patent No.: US 7,194,773 B2
(45) Date of Patent: Mar. 27, 2007

(54) TOILET TOOL

(76) Inventor: Richard Bixby, 4990 Burke Hill Dr., Ukiah, CA (US) 95482

( * ) Notice: Subject to any disclaimer, the term of this patent is extended or adjusted under 35 U.S.C. 154(b) by 780 days.

(21) Appl. No.: 10/273,882

(22) Filed: Oct. 17, 2002

(65) Prior Publication Data

US 2005/0160523 A1 Jul. 28, 2005

(51) Int. Cl.
*E03D 9/00* (2006.01)

(52) U.S. Cl. ..... 4/255.01; 4/255.04

(58) Field of Classification Search ..... 4/255.01, 4/255.04, 427; 30/356, 353, 324
See application file for complete search history.

(56) References Cited

U.S. PATENT DOCUMENTS

| | | | | | |
|---|---|---|---|---|---|
| 507,435 | A | | 10/1893 | Helfensteller | |
| 872,746 | A | * | 12/1907 | Peterson | 4/255.01 |
| D208,995 | S | * | 10/1967 | Anderson | D8/10 |
| 3,480,021 | A | * | 11/1969 | Ewald | 134/24 |
| 4,002,207 | A | * | 1/1977 | Bartz | 172/378 |
| 4,950,013 | A | * | 8/1990 | Yonkers | 294/49 |
| 5,056,177 | A | | 10/1991 | Nast | |
| 5,230,116 | A | | 7/1993 | Rodriguez | |
| D392,070 | S | | 3/1998 | Pitaro et al. | |
| 5,987,683 | A | | 11/1999 | Leiman et al. | |
| 5,987,684 | A | | 11/1999 | Evans | |
| 6,094,765 | A | | 8/2000 | Askenase | |
| 6,464,271 | B1 | * | 10/2002 | Irvin, Jr. | 294/26 |

* cited by examiner

*Primary Examiner*—Henry Bennett
*Assistant Examiner*—Azadeh Kokabi
(74) *Attorney, Agent, or Firm*—Malcolm D. Reid; Gray, Plant, Mooty, Mooty & Bennett, P.A.

(57) ABSTRACT

A tool is constructed and adapted for dislodging debris obstructions in a toilet bowl and similar other drains. An elongate longitudinal shaft extends from a handle end to a curved blade end. The curved blade end is broadened, expanded and flattened from the shaft, the blade gradually curves and narrows from the broadened, expanded and flattened portion to a pointed tip end. Sharpened edges surround the perimeter of the curved blade end. In use, the worker grasps the tool by the handle end and inserts the curved blade end into the debris obstruction. Twisting, chopping and churning actions are exerted with the tool to agitate the debris obstruction to a flushable state.

4 Claims, 5 Drawing Sheets

TOILET TOOL

FIELD OF THE INVENTION

The present invention is a tool for dislodging debris obstructions in a toilet bowl and other similar plumbing fixtures and drains. More particularly, this invention is a tool and a method for using the tool to exert twisting, chopping and churning actions to agitate the debris obstruction to a flushable state.

BACKGROUND OF THE INVENTION

All those involved with the care and maintenance of toilet bowls, drain pipes, tubes and the like are well aware of the difficulty encountered in dislodging and comminuting various types of debris that become lodged in and clog such plumbing passageways. Currently available tools and methods are often ineffective and may require a great deal of time and expertise for proper and effective use. Other available tools and methods are inherently unsanitary, particularly between periods of actual use. The plumbing industry requires a simple, easily usable, and effectively sanitizable tool that even an unskilled worker can use to effectively dislodge debris obstructions to a flushable state. A tool that is easily storable near the toilet bowl, ready for further use, is also required.

SUMMARY OF THE INVENTION

A toilet tool of this invention is designed and adapted for dislodging debris obstructions in a toilet bowl and similar drains and pipes to a readily flushable state. The tool has an elongate longitudinal shaft extending from a handle end to a curved blade end. The curved blade end broadens from the shaft to an expanded and flattened portion. The blade gradually curves and narrows from the flattened portion to a pointed tip end The blade may have a slight spoon shape. Sharpened edges surround the perimeter of the curved blade end.

The handle may be of any suitable shape. A handle with an aperture for hanging the tool may be formed by curving the proximate end of the shaft back on itself and fastening to the shaft. Another handle may be comprised of vanes extending perpendicularly from the proximate end of the shaft and planar parallel to each other, in the style of a "honey dipper." The handle end of the shaft may have a thumb rest for a secure grasp. The tool may have an overall length of more than 12 inches to about 18 inches. The tool may be of a flexible material and construction, such as metal, plastic and combinations thereof.

The novel toilet tool is used to dislodge debris obstructions in a toilet bowl and similar drains and pipes to a readily flushable state. A worker grasps the tool by the handle end and inserts the curved blade end into the debris obstruction in the toilet bowl and beyond the observable point of view if the debris is deeply lodged. The worker exerts twisting, chopping and churning actions with the tool to agitate the debris obstruction to a flushable state. The dislodged debris is then flushed down the drain in the normal manner.

DETAILED DESCRIPTION OF THE INVENTION

Figure 1:
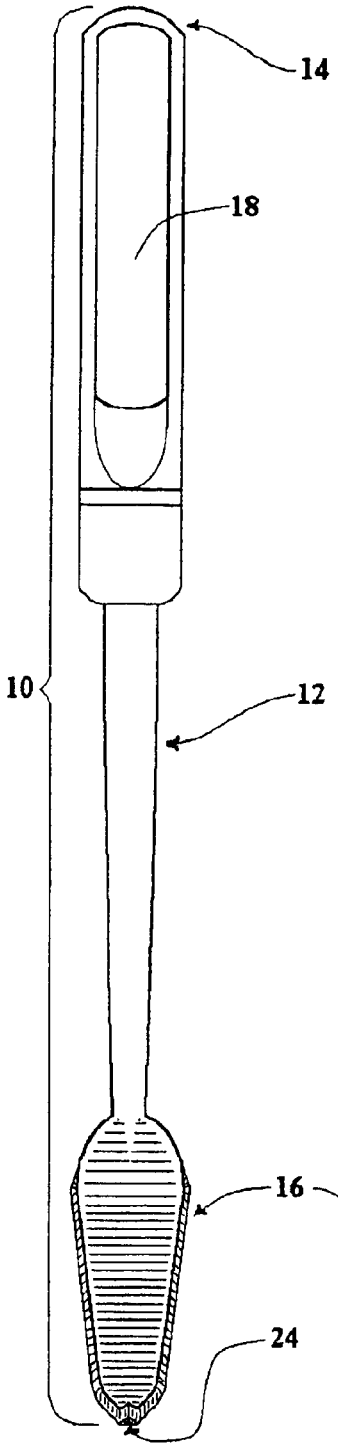
FIG. 1 is a front view of a toilet tool of this invention.
Figure 2B:
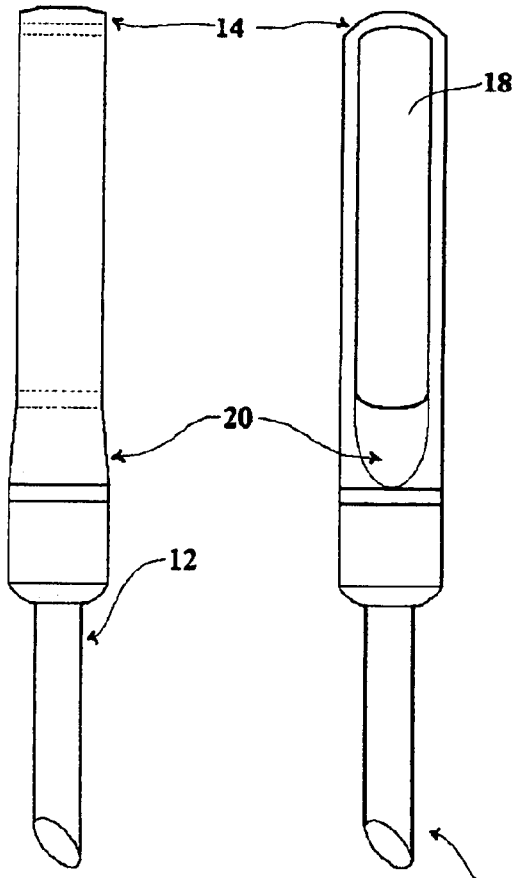
FIG. 2 is a cut-away side view of the elongate longitudinal handle and shaft of the tool of FIG. 1.
FIG. 2A is a top end view of the tool of FIG. 1.
Figure 2A:
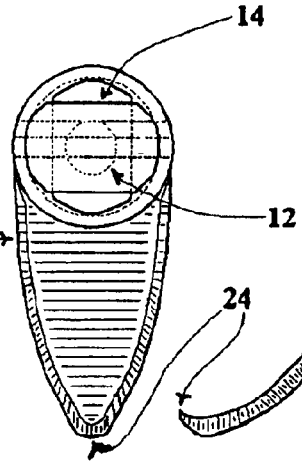
Figure 3:
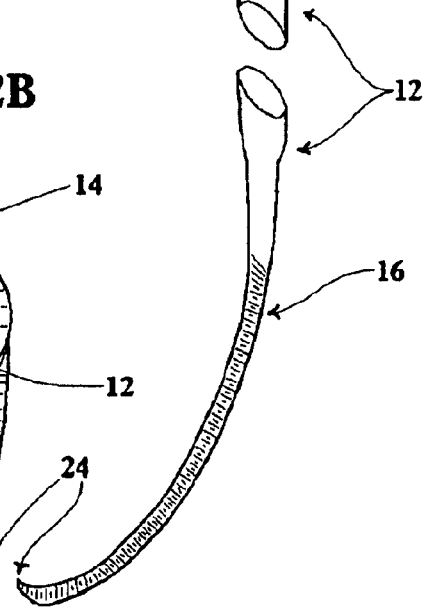
FIG. 3 is a side view of the tool, similar to that shown in FIGS. 1 and 2.

The invention will now be described in detail with reference particularly to FIGS. 1–10, in which all numerals refer to like portions of the inventive tool. FIGS. 1–3 illustrate an embodiment of a toilet tool 10 of this invention. FIG. 1 is a front view of a toilet tool 10. The tool 10 has an elongate longitudinal shaft 12 with a handle end 14 and a curved blade end 16. The handle end 14 is expanded from the cross-sectional area of the shaft 12 to provide a secure grip. The handle end 14 has an aperture 18 for conveniently hanging the tool 10 out of the way yet ready for access. The expanded handle end 14 tapers outward from and then back toward the shaft 12, forming a convenient thumb rest 20, as perhaps better seen in reference to FIG. 2, to further provide a secure grip of the tool 10 in use. FIG. 2A is a top view of the tool of FIG. 1.

The curved blade end 16 broadens from the shaft 12 in an expanded and flattened portion 22, as perhaps better seen in reference to FIGS. 4–7. Note that FIG. 3 shows the handle end 14 rotated 90° from the position shown in FIGS. 1 and 2. This is intended to illustrate that the handle of the present inventive tool may be in either position to suit the requirements of a particular user or a particular situation. The blade 16 gradually curves and narrows from the flattened portion 22 to a pointed tip end 24. Sharpened edges 26 surround the perimeter of the curved blade end 16. Preferably, the curved blade end 16 has a slight spoon-shape 28, as perhaps best seen with reference to FIGS. 4–7.

Figures 4, 5, 6, 7:
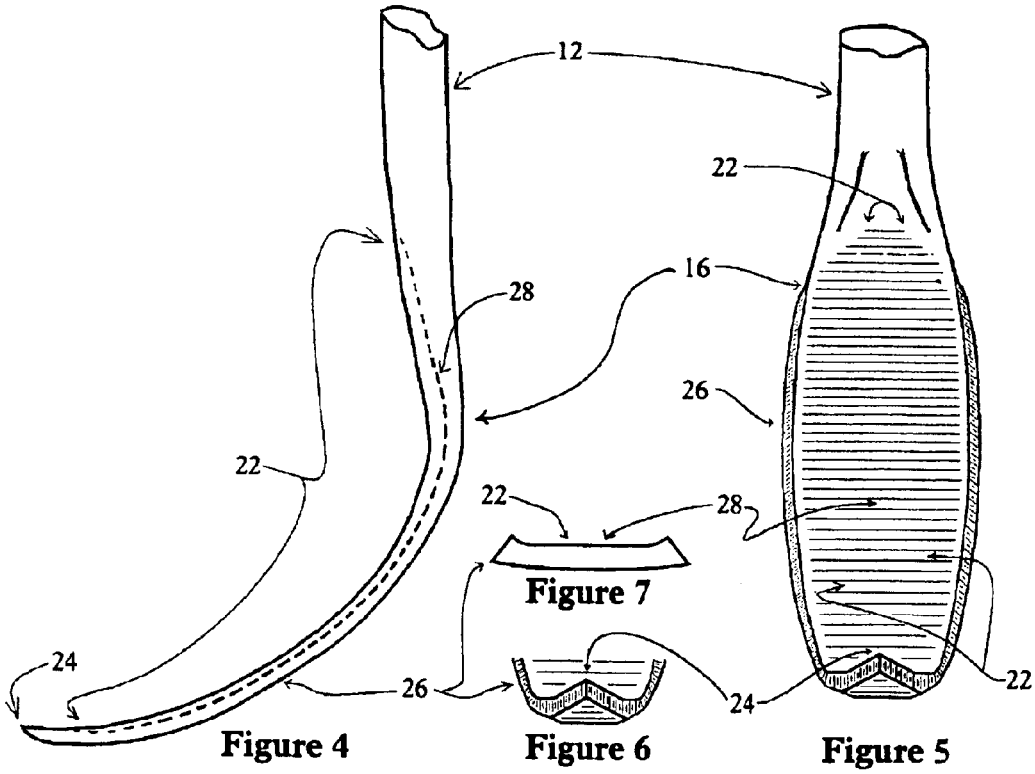
FIG. 4 is a side view of a curved blade of a novel tool.
FIG. 5 is a front view of a curved blade of a novel tool of FIG. 4.
FIG. 6 is a detail of the tip end of the curved blade of the novel tool of FIGS. 4 and 5.
FIG. 7 is a cross-sectional view of a curved blade of the novel tool FIGS. 4–6.

FIGS. 4–7 further illustrate the configuration of the curved blade 16 of the inventive tool 10. FIG. 4 is an enlarged side view of the curved blade 16 of the tool 10. In a tool 10 with an overall length of about 15 inches, about the last 3½ to about 4½ inches form the curved blade 16. The curve of the blade may have a curve diameter of about 2⅜ inches. FIG. 5 is an enlarged perspective view of the curved blade 16 of the tool 10. FIG. 6 shows that the sharpened edges 26 of the curved blade 16 may have a beveled edge. The detail of FIG. 7 shows that the beveled edge 26 may have a thickness of about 1/16 of an inch and a bevel angled back from the edge 26 to about 1/16 of an inch. The spoon-shape 28 of the curved blade 16 is perhaps best illustrated in comparing FIGS. 5 and 7, where the blade 16 has a width of about ⅞ of an inch, the spoon depth is about 3/64 of an inch.

Figure 8:
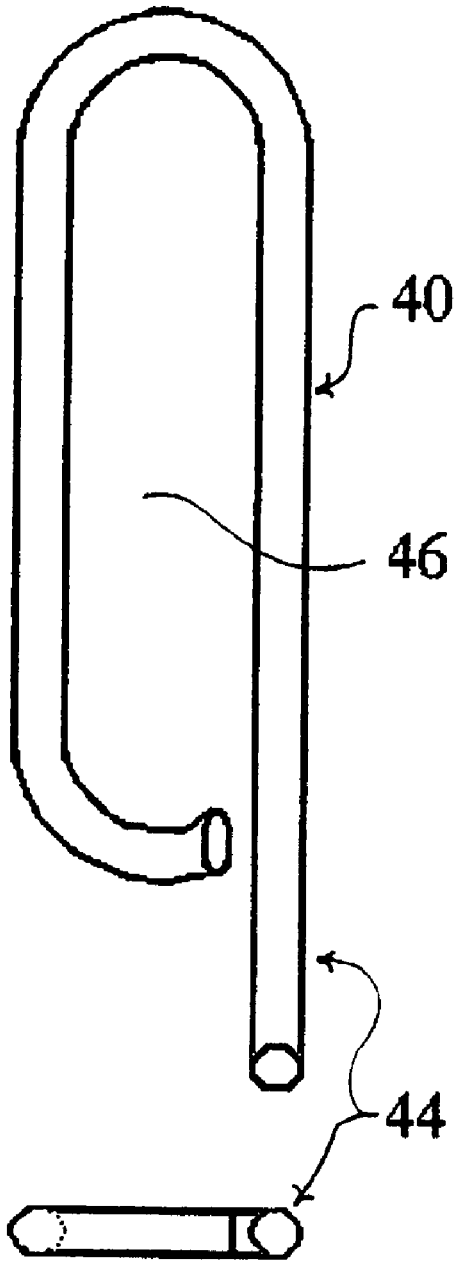
FIG. 8 illustrates an alternate handle of a toilet tool of this invention, in which the shaft turns back on itself to form a handle and hanging loop.

An effective handle can be an extended shaft loop 40, as shown in FIG. 8. The handle 40 portion extends coextensive with the shaft 44 about 5 inches proximally beyond the length of the shaft 44 of the tool. The shaft 44 bends back on itself in about a 180° curve to run parallel to the shaft 44 at a determined hand length space and then bends, with an additional curve of about 90°, to join shaft 44 as one integrally molded handle 40 or bends to nearly contact tool shaft 44. This design forms both a comfortable, secure handle 40, and an aperture 46 to hang the tool.

Figure 9:
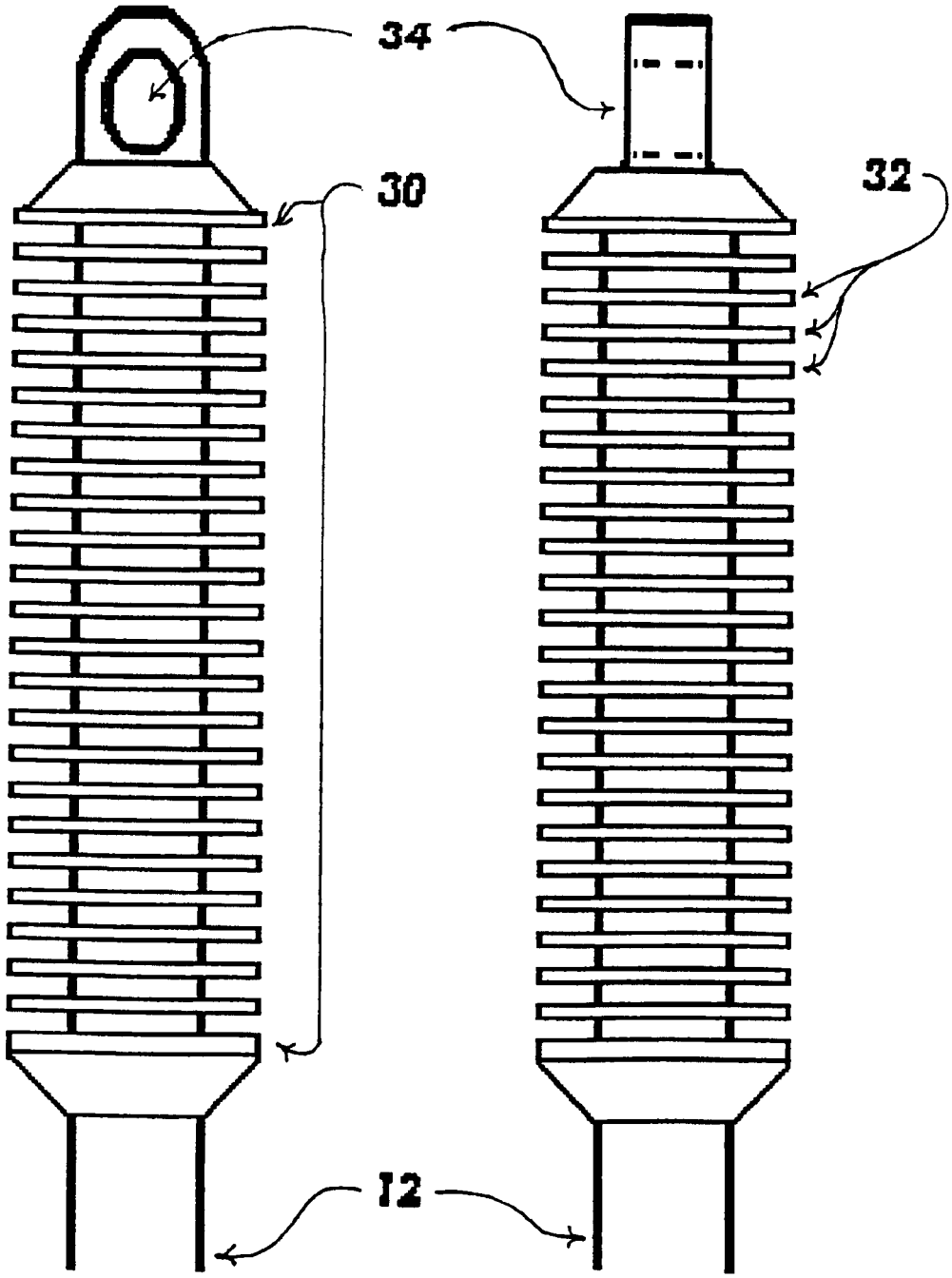
FIG. 9 illustrates an alternate handle of a toilet tool of this invention, with vanes extending perpendicular to the handle and mutually parallel to each other, in the fashion of a "honey dipper."

FIGS. 9 illustrates another handle 30 for a toilet tool of this invention, with vanes 32 extending perpendicular to the shaft 12 at the handle end. The vanes 32 are parallel to each other in the general fashion of a "honey dipper." This handle 30 provides resiliency to ensure a comfortable, secure and workable grasp by workers of various hand sizes and grip strength. A convenient hanger hole 34 is also provided.

Figure 10:
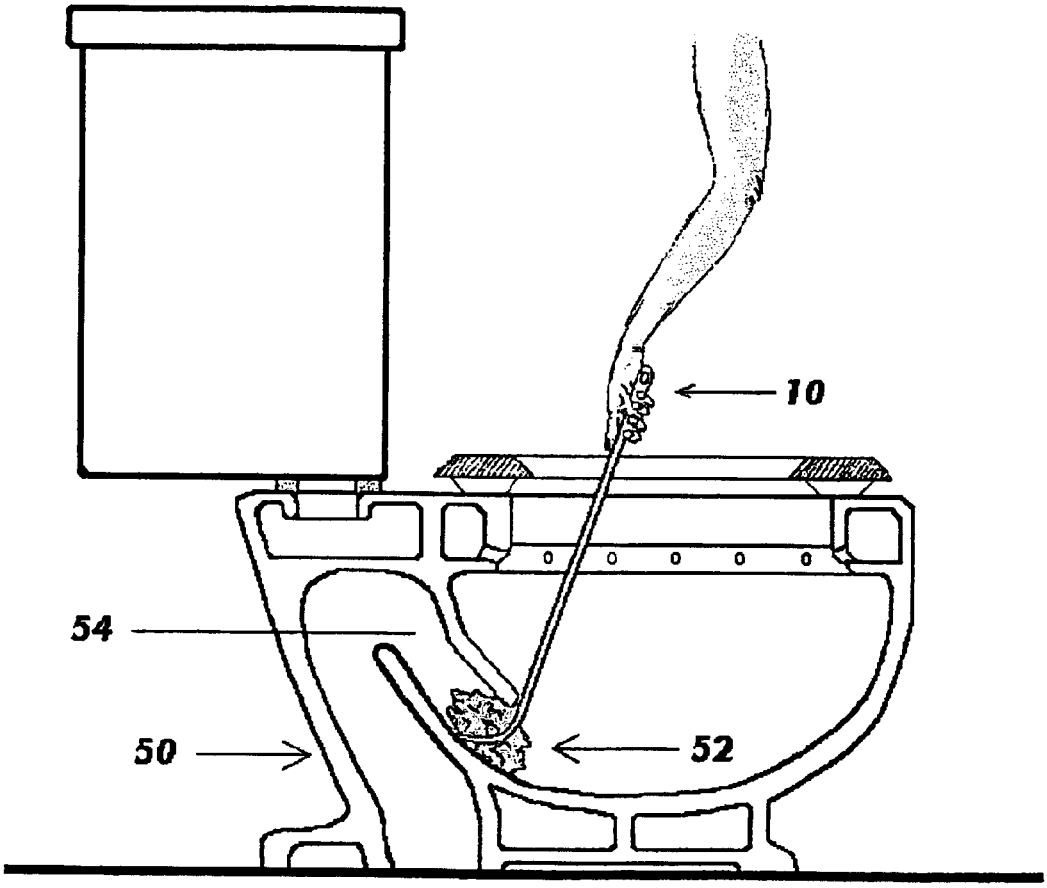
FIG. 10 is a cut-away side view of a conventional toilet fixture with an obstruction lodged at the toilet trap, showing a novel tool in position for use.

FIG. 10 is a cut-away side view of a conventional toilet fixture 50 with an obstruction 52 lodged in the toilet trap 54, where most obstructions occur. The novel tool 10 is shown in position for use.

Plastic is a preferred material for the inventive tool based on strength, flexibility, corrosion resistance, material life and ease of cleaning. The service environment, including cleaning chemicals and extreme water temperatures, presents some difficulty with many materials. Plastic, an industry standard for many toilet tools, offers less of a tendency to mar a glazed or porcelain surface. Fiberglass is a strong composite material suitable for a professional or industrial grade tool. Metals, such as brass or aluminum, are easy to form and long lasting, and may be plastic-coated to be non-damaging to fixtures. Plastics provide the desired forgiveness, flexibility, design retention, and tool durability. Working contact requires impact forgiveness and flexibility to ensure effectiveness. The tool requires a smooth surface for appearance and ease of sanitation.

The term plastic is intended in its broadest sense to include various types of materials. Acrylic nylon and polyvinyl recycled material are two representative materials that have been found to be suitable, because they are hard and strong, resistant to the debris and chemicals they may contact in use, easily cleanable, and ensuring long-life for the tool. Any other plastic material that will meet the needs of the inventive tool would be suitable.

The tool length is determined relative to the depth of a standard toilet bowl dimension measured from the bowl inner rim to the drain throat at the bottom of the trap. See, for example, FIG. 10 illustrating a standard toilet bowl fixture 50 with the tool of this invention in position for use. Toilet water depth, the desired sanitary margin, and the length of handle grip also determine tool length. A standard toilet bowl depth dimension can range anywhere from more than about 12 inches up to about 18 inches. A tool between about 15 inches up to about 18 inches allows extended reach of several inches into the occluded drain area beyond the throat ridge, without the need for hand submersion or tool distortion. A 15-inch tool will fit into a space occupied by a conventional toilet brush caddy.

The shaft diameter is determined by resistance to breakage. A more heavily shafted tool may be required to agitate a large obstruction to a flushable state. The shaft may be of any desired cross-sectional shape, such as a round and square shaft style. Typically, a shaft cross-sectional measurement of about ¼ inch or slightly larger has been found suitable under actual use conditions. A round smooth plastic shaft allows the necessary degree of flexing and ease of cleaning. The shaft may be tapered. A tapered shaft may be thickest at the handle with progressively increasing flexibility toward the tip to avoid a possible fatigue break at the base of the handle or along the shaft. The diameter of the handle should be sufficient to allow the worker to impart twist to the shaft without the tool slipping in the worker's hand.

The curved cutting blade of the toilet tool of this invention is designed to tear, chop, and chum through waste that may be floating, submerged, or lodged in a stationary positioned. A stationary obstruction is easiest to dislodge. A floating or submerged obstruction is more difficult to dislodge, because swift chopping movements are required without splashing the worker or the surroundings. The pointed tip end of the blade is designed to pick, spear, or penetrate obstructions at an obtuse angle, to include even obstructions in the out of view portion of the drain. In a reverse pick and pull direction, the worker can even retrieve lost or misplaced items, such as small toys, eyeglasses, and jewelry. The curve of the point can range from about 45° to about 90°, for example, about 60°. The curved point adds to the extended reach beyond the drain throat, allowing deeply submerged obstructions to be broken up and flushed free.

Cut resistant buoyant waste material may be difficult to dislodge to a flushable condition. Quick swirls with a chopping action have usually been found to be most effective. The thin sharpened blade edge can pin down and cut or chop the waste, while avoiding unwanted splashing. The curved blade also allows the user to chop and cut at the material without dragging the pointed end back and forth over the porcelain. The point allows spearing the obstructing material, then rolling over the toilet tool edge and making a cut. The length and curve of the blade and of the point can be designed and constructed to meet the needs of a particular use situation and plumbing fixture. The arched profile of the cutting blade is used to churn the water and waste to a slurry consistency. The spoon shape reinforces the tool's working strength.

Best results are obtained by using the novel tool as soon as a toilet obstruction is noted and before any flushing is attempted. Flushing an obstructed toilet can lead to plugging. However, if an obstruction becomes apparent after an attempted flush, the novel tool can remedy this situation as well. The worker takes the tool by the handle, submerges the curved blade into the waste and wastewater, and agitates the accumulation into a flushable consistency. The resulting slurry is then ready to be flushed. If the consistency of the waste is hard and resistant to water disbursement the cutting edge of the tool breaks the obstruction into smaller pieces. Water flow, water volume, toilet style, drain size and drain line waste retention all affect the ability to flush the obstruction.

If there is no visible obstruction and the toilet is plugged with standing water, the worker takes the handle of the tool and submerges the tip deeply enough to create a swirling, circular vortex motion in the wastewater to loosen the debris. The circular vortex motion also dislodges the deep debris to allow the water in the bowl to flush free or to allow high water in the bowl to seep down the drain, to a workable level. Therefore, with use of the novel toilet tool of this invention overflow of water out of the bowl is almost never a problem.

That which is claimed is:

1. A method of dislodging debris obstructions in a toilet bowl and the like with a tool comprising:

an elongate longitudinal shaft extending from a handle end to a curved blade end; and the curved blade end broadened from the shaft in an expanded and flattened portion, the blade gradually curved and narrowed from the flattened portion to a pointed tip end, with sharpened edges around a perimeter of the curved blade end, the method comprising: (a) grasping the tool by the handle end; (b) inserting the curved blade end into the debris obstruction; and (c) agitating the debris obstruction to a flushable state.

2. A toilet bowl cleaning apparatus, comprising:

(a) a toilet bowl adapted to hold a quantity of water;

(b) a debris dislodging tool, having (i) an elongate longitudinal shaft extending from a handle end to a curved blade end, the curved blade end insertable in and removable out of the toilet bowl;

(ii) the curved blade end broadened from the shaft in an expanded and flattened portion, the blade gradually curved and narrowed from the flattened portion to a pointed tip end, with sharpened edges around a perimeter of the curved blade end;

(iii) the elongate longitudinal shaft of a length that when the handle is at least above a toilet bowl water line, the curved blade end extends at least below the toilet bowl water line; and (c) wherein, when the curved blade end is Inserted below the toilet bowl waterline and the handle is moved in a twisting, chopping, or churning motion or a combination of such motions, the curved blade end agitates the lodged debris in the toilet bowl into a flushable state.

3. A method of dislodging debris obstructions in a toilet bowl and the like with a tool comprising:

(a) an elongate longitudinal shaft extending from a handle end to a curved blade end; and (b) the curved blade end broadened from the shaft in an expanded and flattened portion, the blade gradually curved and narrowed from the flattened portion to a pointed tip end, with sharpened edges around a perimeter of the curved blade end, the method comprising: (a) grasping the tool by the handle end and (b) inserting the curved blade end deeply enough into the toilet bowl to create a swirling, circular vortex motion in the wastewater to loosen a debris obstruction in the out of view portion of the drain and allow the water in the bowl to flush free.

4. A tool for dislodging debris obstructions in a toilet bowl and the like, the tool comprising:

an elongate longitudinal shaft extending from a handle end to a curved blade end, wherein at least the curved blade end extends into a drain throat of the toilet bowl;

the curved blade end broadened from the shaft in an expanded and flattened portion, the blade gradually curved and narrowed from the flattened portion to a pointed tip end, with sharpened edges around a perimeter of the curved blade end; and having an overall length at least equal to the distance from the inner rim of a toilet bowl to a drain throat at the bottom of the toilet bowl trap.

* * * * *